US011351798B2

(12) United States Patent
Ban et al.

(10) Patent No.: US 11,351,798 B2
(45) Date of Patent: Jun. 7, 2022

(54) PRINTING APPARATUS

(71) Applicant: SEIKO EPSON CORPORATION, Tokyo (JP)

(72) Inventors: Ryosuke Ban, Shiojiri (JP); Naoki Oki, Matsumoto (JP); Yuki Moriya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 16/826,578

(22) Filed: Mar. 23, 2020

(65) Prior Publication Data

US 2020/0307260 A1 Oct. 1, 2020

(30) Foreign Application Priority Data

Mar. 25, 2019 (JP) ..... JP2019-056744

(51) Int. Cl.
*B41J 11/00* (2006.01)

(52) U.S. Cl.
CPC ..... *B41J 11/007* (2013.01)

(58) Field of Classification Search
CPC ..... B41J 11/007
See application file for complete search history.

(56) References Cited

U.S. PATENT DOCUMENTS 5,034,779 A * 7/1991 Newbury ..... G03G 21/0005 399/111
10,611,158 B2 * 4/2020 Nakamura ..... B41J 2/16526
11,040,552 B2 * 6/2021 Yoda ..... B41J 11/00212
2003/0025763 A1 * 2/2003 Sturgeon ..... B41J 2/1752 347/49
2003/0025764 A1 * 2/2003 Sturgeon ..... B41J 2/17553 347/49
2017/0313103 A1 11/2017 Miyazaki et al.

FOREIGN PATENT DOCUMENTS

JP 2017-197354 A 11/2017

* cited by examiner

*Primary Examiner* — Sharon Polk
(74) *Attorney, Agent, or Firm* — Workman Nydegger

(57) ABSTRACT

A printing apparatus includes a printing portion configured to perform printing on a printing surface of a medium, a transporting portion configured to transport the medium in a transport direction, a medium supporting portion located upstream of the printing portion in the transport direction, the medium supporting portion including a medium supporting surface configured to support the medium, a preprocessing portion configured to perform preprocessing on the medium supported by the medium supporting portion, and a mount portion facing the medium supporting surface, the mount portion being configured such that the preprocessing portion is detachably mounted thereto. The mount portion includes a position-setting mechanism configured to set a position of the preprocessing portion with respect to the medium supporting surface.

8 Claims, 8 Drawing Sheets

PRINTING APPARATUS

The present application is based on, and claims priority from JP Application Serial Number 2019-056744, filed Mar. 25, 2019, the disclosure of which is hereby incorporated by reference herein in its entirety.

BACKGROUND

1. Technical Field

The present disclosure relates to a printing apparatus.

2. Related Art

JP-A-2017-197354 discloses that a preprocessing portion serving as a removing portion configured to remove foreign matters such as dust particles or fuzz attached to a printing surface of a medium is detachable from a fixed portion. With such a configuration, maintenance is performed to restore the foreign-matter removing performance, i.e., the preprocessing performance, of the preprocessing portion.

However, the above-described configuration has the following problems. Specifically, the preprocessing performance of the preprocessing portion varies depending on the position of the preprocessing portion with respect to the medium, and in turn, the medium supporting portion. In the above-described configuration, there is a risk that the position of the preprocessing portion with respect to the fixed portion changes when attaching or detaching the preprocessing portion to or from the fixed portion.

SUMMARY

To solve the above-described problems, a printing apparatus of the present disclosure includes a printing portion configured to perform printing on a printing surface of a medium, a transporting portion configured to transport the medium in a transport direction, a medium supporting portion located upstream of the printing portion in the transport direction, the medium supporting portion including a medium supporting surface configured to support the medium, a preprocessing portion configured to perform preprocessing on the medium supported by the medium supporting portion, and a mount portion facing the medium supporting surface, the mount portion being configured such that the preprocessing portion is detachably mounted thereto. The mount portion includes a position-setting mechanism configured to set a position of the preprocessing portion with respect to the medium supporting surface.

DESCRIPTION OF EXEMPLARY EMBODIMENTS

Figure 1:
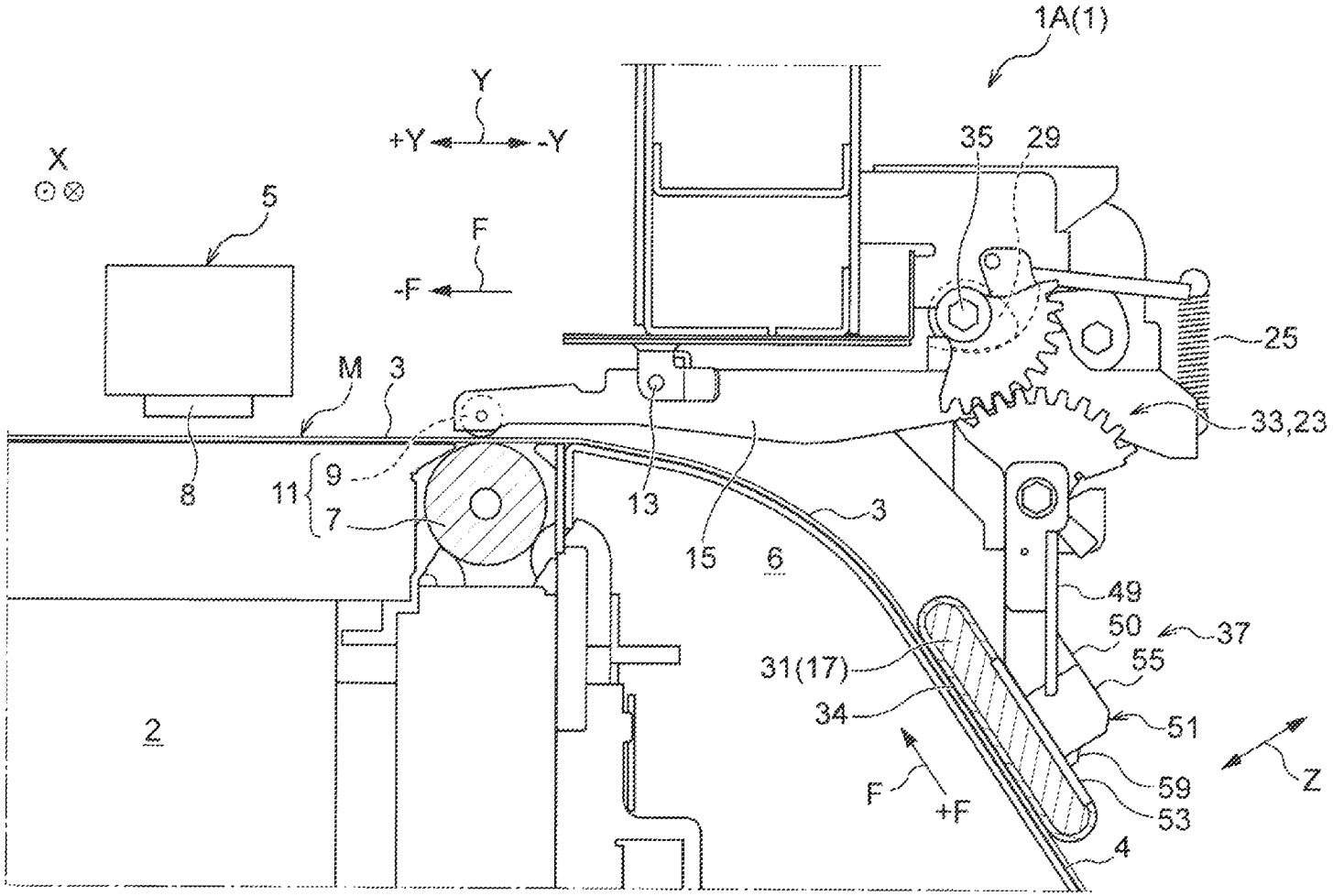
FIG. 1 is an enlarged side sectional view illustrating a main portion of a printing apparatus according to a first embodiment of the present disclosure.

First, the present disclosure is schematically described.

A printing apparatus according to a first aspect of the present disclosure for solving the above-described problems includes a printing portion configured to perform printing on a printing surface of a medium, a transporting portion configured to transport the medium in a transport direction, a medium supporting portion located upstream of the printing portion in the transport direction, the medium supporting portion including a medium supporting surface configured to support the medium, a preprocessing portion configured to perform preprocessing on the medium supported by the medium supporting portion, and a mount portion facing the medium supporting surface, the mount portion being configured such that the preprocessing portion is detachably mounted thereto. The mount portion includes a position-setting mechanism configured to set a position of the preprocessing portion on the medium supporting surface.

According to the present aspect, the mount portion includes a position-setting mechanism configured to set a position of the preprocessing portion with respect to the medium supporting surface. In other words, the mount portion has a structure that serves also as a position setting portion configured to set the position of the preprocessing portion with respect to the medium supporting surface, and therefore, by mounting the preprocessing portion to the mount portion, the preprocessing portion can be disposed at an appropriate position with respect to the medium transporting surface.

Thus, even when the preprocessing portion is attached or detached to or from the mount portion, the position of the preprocessing portion with respect to the medium supporting surface is easily maintained at a predetermined position and reduction in preprocessing performance can be suppressed.

The printing apparatus according to a second aspect of the present disclosure is the printing apparatus according to the first aspect in which the position-setting mechanism is a snap fit.

According to the present aspect, the position-setting mechanism is a snap fit, and thus the position of the preprocessing portion with respect to the medium supporting surface can be set with a simple configuration.

The printing apparatus according to a third aspect of the present disclosure includes a printing portion configured to perform printing on a printing surface of a medium, a transporting portion configured to transport the medium in a transport direction, a medium supporting portion located upstream of the printing portion in the transport direction, the medium supporting portion including a medium supporting surface configured to support the medium, a preprocessing portion configured to perform preprocessing on the medium supported by the medium supporting portion, and a mount portion facing the medium supporting surface, the mount portion being configured such that the preprocessing portion is detachably mounted thereto. The mount portion is disposed to the medium supporting surface such that the medium supporting surface serves as a guide for mount the preprocessing portion to the mount portion.

According to the present aspect, the mount portion and the medium supporting surface are arranged in a relative arrangement such that the preprocessing portion can be mounted to the mount portion with the medium supporting surface as a guide. Thus, the preprocessing portion can be easily mounted to the mount portion.

In particular, in the case of a structure in which two or more mount parts are provided for one preprocessing portion, it is not easy to align each of the mount parts of the preprocessing portion side to the two or more mount parts when no guide is provided.

According to the present aspect, even with such a structure, an operation of aligning the mount portion of the preprocessing portion side to the mount portion is easily performed with the medium supporting surface serving as a guide, and thus the operability for mounting the preprocessing portion can be improved.

In addition, the above-described relative arrangement is also effective in that the position of the preprocessing portion with respect to the medium supporting surface is easily maintained at a predetermined position.

The printing apparatus according to a fourth aspect of the present disclosure is the printing apparatus according to the first or second aspect in which the mount portion is disposed to the medium supporting surface such that the medium supporting surface serves as a guide for mounting the preprocessing portion to the mount portion.

The printing apparatus according to a fifth aspect of the present disclosure is the printing apparatus according to any one of the first to fourth aspects, in which the preprocessing portion includes a flat surface portion that is configured to contact with the medium supporting surface in a state where the preprocessing portion is mounted to the mount portion.

According to the present aspect, the preprocessing portion includes a flat surface portion that is configured to contact with the medium supporting surface in a state where the preprocessing portion is mounted to the mount portion, and thus the operability for mounting the preprocessing portion can be further improved by guiding the flat surface portion along the medium supporting surface. In addition, the position of the preprocessing portion with respect to the medium supporting surface is further easily maintained at a predetermined position.

The printing apparatus according to a sixth aspect of the present disclosure is the printing apparatus according to any one of the first to fifth aspects, in which the medium supporting surface is an inclined surface with an rising slope that intersects an access direction of attaching the preprocessing portion to or from the mount portion.

According to the present aspect, the medium supporting surface is an inclined surface with an rising slope that intersects an access direction of attaching or detaching the preprocessing portion to or from the mount portion. The inclined surface provides an effect of further improving the user operability for mounting the preprocessing portion.

The printing apparatus according to a seventh aspect of the present disclosure is the printing apparatus according to any one of the first to sixth aspects, in which the transporting portion is disposed upstream of the printing portion in the transport direction, and the preprocessing portion and the mount portion are disposed upstream of the transporting portion in the transport direction.

According to the present aspect, the preprocessing portion and the mount portion are disposed upstream of the transporting portion in the transport direction, and thus the user accessibility in the attaching/detaching operation is improved and maintenance of the preprocessing portion is easily performed.

The printing apparatus according to an eighth aspect of the present disclosure is the printing apparatus according to any one of the first to seventh aspects, and further includes a second preprocessing portion disposed upstream of the printing portion in the transport direction. The preprocessing portion and the second preprocessing portion are provided side by side along an intersecting direction intersecting the transport direction.

According to the present aspect, the preprocessing portion and the second preprocessing portion are provided side by side along an intersecting direction intersecting the transport direction. As such, in the case where the preprocessing portion is degraded by contamination, scratches, and the like, it is only necessary to replace the degraded one of the preprocessing portion and the second preprocessing portion, and thus the maintenance cost of the preprocessing portion can be suppressed.

The printing apparatus according to a ninth aspect of the present disclosure is the printing apparatus according to any one of the first to eighth aspects, in which the preprocessing portion is a dust catcher configured to collect dust adhered to a surface of the medium.

The printing apparatus according to a tenth aspect of the present disclosure includes a printing portion configured to perform printing on a printing surface of fabric, a transporting portion configured to transport the fabric in a transport direction, a fabric supporting portion disposed upstream of the printing portion in the transport direction, the fabric supporting portion including a fabric supporting surface configured to support the fabric, a fuzz compression portion located upstream of the printing portion in the transport direction, the fuzz compression portion being configured to compress fuzz of the printing surface, and a mount portion facing the fabric supporting surface, the mount portion being configured such that the fuzz compression portion is detachably mounted to the mount portion. The mount portion includes a position-setting mechanism configured to set a position of the fuzz compression portion on the fabric supporting surface when the fuzz compression portion is mounted.

According to the present aspect, the same effects as those of the above-described aspects can be achieved with the fuzz compression portion as one of the preprocessing parts in the printing apparatus configured to perform printing on the fabric.

Now embodiments of the present disclosure are described below with reference to the accompanying drawings.

In the following description, an overview of an overall configuration of a printing apparatus according to a first embodiment is described first with reference to FIG. 1. Next, specific configurations of a medium supporting surface, a preprocessing portion, and a mount portion that are main parts of the embodiment are described with reference to FIGS. 2 to 5.

Embodiment 1

1. Overview of Overall Configuration of Printing Apparatus (FIGS. 1 and 2)

The printing apparatus 1 according to the present disclosure includes a printing portion 5 configured to perform printing on a printing surface 3 of a medium M, a transporting portion 11 configured to transport the medium M in a transport direction F, a medium supporting surface 4 located upstream +F of the printing portion 5 in the transport direction F and configured to support the medium M, a preprocessing portion 17 configured to perform preprocessing on the medium M supported by the medium supporting surface 4, and a mount portion 50 located opposite the medium supporting surface 4 and configured such that the preprocessing portion 17 is detachably mounted to mount portion 50.

The mount portion 50 includes a position-setting mechanism 37 configured to set the position of the preprocessing portion 17 with respect to the medium supporting surface 4 when the preprocessing portion 17 is mounted.

A printing apparatus 1A illustrated in the drawings is an inkjet printer of a type in which medium M, such as paper, is inserted and set from the back side of a device main body 2, and a medium supporting portion 6 including a curved medium supporting surface 4 as an example of a support of the medium M is provided on the back side of the device main body 2 from the transporting portion 11 to the preprocessing portion 17.

The printing portion 5 is provided at a position downstream −F of a transport roller 11 serving as the transporting portion in the transport direction F of the medium M, and includes a discharging head 8 configured to execute printing by discharging liquid such as ink of each color supplied from an ink tank (not illustrated) or the like toward the printing surface 3 of the medium M.

The transport roller 11 serving as the transporting portion is composed of a pair of nip rollers including a driving roller 7 on the lower side and a driven roller 9 on the upper side. The driven roller 9 is provided in a freely rotatable manner at an end portion on the front +Y side in the depth direction Y in a driven roller holder 15.

The driven roller holder 15 is a member elongated in the depth direction Y and includes a turning fulcrum 13 at a position on a slightly rear side relative to the end portion on the front +Y side where the driven roller 9 is provided.

Note that the transport direction F of the medium M transported by the transport roller 11 is substantially parallel with the depth direction Y in the region near the printing portion 5.

The preprocessing portion 17 is composed of a plate-like member extending in the width direction X of the device main body 2.

In addition, as illustrated in FIG. 2, in this embodiment, six preprocessing parts 17 are provided side by side in the width direction X of the device main body 2, for example. Specifically, one preprocessing portion 17 and five second preprocessing parts 17 are provided side by side along the width direction X, which is an intersecting direction intersecting the transport direction F.

In other words, one preprocessing portion 17 and five other preprocessing parts 17 disposed upstream +F of the printing portion 5 in the transport direction F are provided. Each of the five second preprocessing parts 17 has the same structure as the one preprocessing portion 17.

In addition, the end portion on the upstream +F side and the end portion on the downstream −F side of the preprocessing portion 17 in the transport direction F each have a shape of a curved convex surface. Thus, the medium M can be smoothly transported by reducing the risk of catching of the medium M passing between the preprocessing portion 17 and the medium supporting surface 4 of the medium supporting portion 6.

In this embodiment, a dust catcher 31 configured to collect and remove foreign matters (dust) such as paper dust, dirt, and dust particles adhered to the printing surface 3 of the medium M is assembled as the preprocessing portion 17. Examples of the material of the dust catcher 31 may include a cloth, a porous material, and a rubber.

Further, in this embodiment, the preprocessing portion 17 is configured to be switchable between a contact state where the preprocessing portion 17 is brought into contact with the printing surface 3 of the medium M and a separation state where the preprocessing portion 17 is separated from the printing surface 3 of the medium M, in association with a movement of the driven roller holder 15 that turns about the turning fulcrum 13.

As a mechanism for achieving such an associated movement, a power transmission mechanism 23 composed of a gear transmission mechanism 33 that utilizes the drive force of a rotation shaft 35 of a release cam 29 is provided. The tip end of a support arm 49 provided at the output end of the power transmission mechanism 23 is the mount portion 50.

Position-Setting Mechanism

The dust catcher 31 is held by an attaching holder 51 that includes a flat mounting seat plate 53 and two socket parts 55L and 55R provided in the mounting seat plate 53 at the left and right portions in the width direction X. The two socket parts 55L and 55R are a fitting portion 55 configured for fit with the mount portion 50 of the tip end of the support arm 49.

Then, by mounting the fitting portion 55 to the mount portion 50, the position of the dust catcher 31 held by the attaching holder 51 is set with respect to the medium supporting surface 4, in the height direction Z, the transport direction F, and the width direction X.

In this embodiment, the position-setting mechanism 37 is composed of the fitting structure of the mount portion 50 and the fitting portion 55.

2. Specific Configuration of Main Parts of Printing Apparatus (See FIGS. 2 to 5)

In this embodiment, the position-setting mechanism 37 is a snap-fit mechanism that easily sets the position by simply inserting, into two mount parts 50L and 50R of the support arms 49, the two socket parts 55L and 55R of the attaching holder 51 on which the dust catcher 31 is attached.

The position-setting mechanism 37 using the snap-fit mechanism is described with reference to FIGS. 3 to 5. Each of the socket parts 55L and 55R provided in the attaching holder 51 includes an engagement hole 57 that opens at the lower end, and an elastic engaging claw 61 provided on the outer side of the socket portion 55L or 55R. Each of the mount parts 50L and 50R provided in the support arm 49 includes an engaging claw 59 that can be inserted into the engagement hole 57, and an engagement receptacle 63 that can engage with the elastic engaging claw 61. The socket parts 55L and 55R are removed from the mount parts 50L and 50R in the following manner. The elastic engaging claws 61 of the socket parts 55L and 55R are pinched and released from the engagement receptacles 63 provided in the mount parts 50L and 50R. Then, the engaging claws 59 come out from the engagement holes 57. In this manner, the attaching holder 51 can be removed from the mount portion 50 through a simple operation that does not require a tool.

In this embodiment, in the printing apparatus 1A including the printing portion 5, the transporting portion 11, the medium supporting surface 4, and the mount portion 50, the relative arrangement of the mount portion 50 and the medium supporting surface 4 is set such that the preprocessing portion 17 can be mounted to the mount portion 50 with the medium supporting surface 4 as a guide. In other words, the mount portion 50 is disposed with respect to the medium supporting surface 4 such that the medium supporting surface 4 serves as a guide for mounting the preprocessing portion 17 (the dust catcher 31) to the mount portion 50. Specifically, the position of the mount portion 50 with respect to the medium supporting surface 4 is set such that at least one of the extending direction of the support arm 49 and the extending direction of the mount portion 50 is substantially parallel to the medium supporting surface 4 in the state where the preprocessing portion 17 is set in a posture for making contact with the medium M or the medium supporting surface 4.

In this embodiment, the bottom surface of the dust catcher 31 that makes contact with the medium supporting surface is composed of a flat surface portion 34. The fitting portion 55 can be easily mounted to the mount portion 50 by sliding, on the medium supporting surface 4, the flat surface portion 34 of the dust catcher 31 that makes contact with the medium supporting surface 4 in the state where the fitting portion 55 of the attaching holder 51 on which the dust catcher 31 serving as the preprocessing portion 17 is attached is mounted to the mount portion 50.

Further, in this embodiment, the medium supporting surface 4 is composed of an inclined surface with an rising slope that intersects the access direction of attaching or detaching the preprocessing portion 17 to or from the mount portion 50. The access direction is a direction parallel with the depth direction Y at the back side of the device main body 2. Specifically, the access direction is the same direction as the front +Y in the depth direction Y at the back side of the device main body 2.

Thus, the user can easily mount the fitting portion 55 to the mount portion 50 located obliquely upward with good operability by placing the flat surface portion 34 of the bottom surface of the dust catcher 31 at an upstream +F position of the medium supporting surface 4 while holding the attaching holder 51 in which the dust catcher 31 is attached, and then by pushing and sliding it obliquely upward on the inclined medium supporting surface 4.

In addition, in this embodiment, the transporting portion 11 is disposed upstream +F of the printing portion 5 in the transport direction F. Further, the preprocessing portion 17 and the mount portion 50 are disposed upstream +F of the transporting portion 11 in the transport direction F. Thus, the user accessibility in the attaching/detaching operation of the preprocessing portion 17 to or from the mount portion 50 is improved, and the maintenance of the preprocessing portion 17 is eased. Specifically, it is possible to reduce a situation where the transporting portion 11 and the printing portion 5 interfere with the attaching/detaching operation of the preprocessing portion 17 to or from the mount portion 50 in comparison with the case where the preprocessing portion 17 and the mount portion 50 are disposed between the transporting portion 11 and the printing portion 5 in the transport direction F. Specifically, as illustrated in FIGS. 1 and 2, six pairs of mount parts 50 are provided at positions that are easily visually recognized and easily accessed in the back side of the device main body 2, and the attaching holder 51 on which the preprocessing portion 17 including the two corresponding socket parts 55L and 55R are attached can be mounted to the two mount parts 50L and 50R of each pair.

3. Operating States of Main Portion in Printing Apparatus (See FIGS. 3 to 5)

Next, details of operating states of the main parts of the printing apparatus 1A according to this embodiment having the above-described configuration are separately described in (A) a state before the preprocessing portion is mounted, and (B) a state after the preprocessing portion is mounted.

Figure 3:
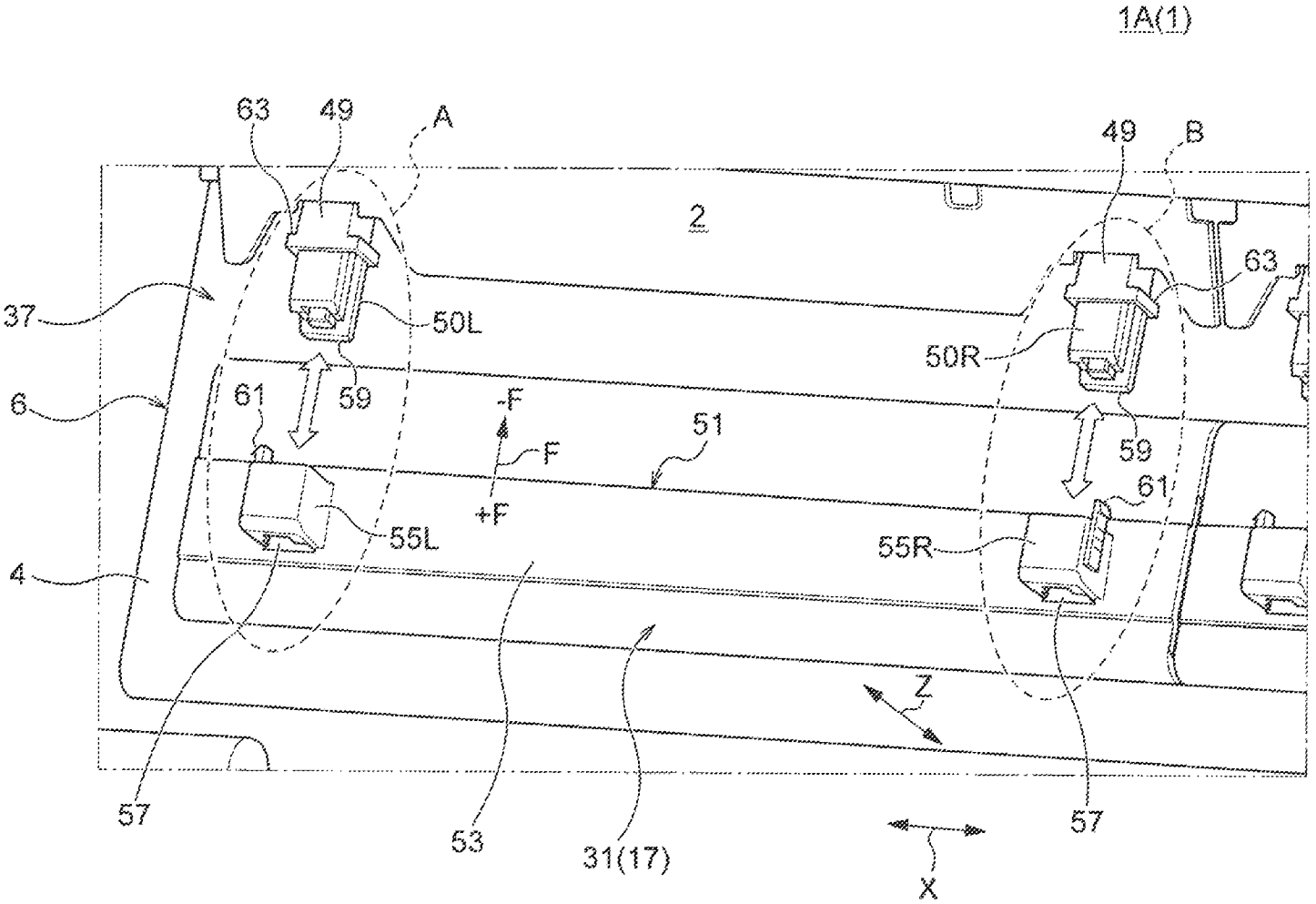
FIG. 3 is a perspective view illustrating an operating state of a main portion of the printing apparatus according to the embodiment of the present disclosure in a state before a preprocessing portion is mounted.

(A) State Before Preprocessing Portion is Mounted (See FIG. 3)

To attach the dust catcher 31 serving as the preprocessing portion 17 to the device main body 2 of the printing apparatus 1A, the dust catcher 31 having been subjected to maintenance and attached to the attaching holder 51 is prepared. The maintenance is a process in which dust or the like adhered to the dust catcher 31 is removed in advance so as to clean at least the flat surface portion 34 of the bottom surface of the dust catcher 31. Then, the flat surface portion 34 of the bottom surface of the dust catcher 31 is brought into contact with a position of the upstream +F of the medium supporting surface 4 of the medium supporting portion 6 as illustrated in FIG. 3. In such a state, the socket parts 55L and 55R serving as the mount portion of the attaching holder 51 are brought closer to the corresponding mount parts 50L and 50R on the device main body 2 side by sliding the attaching holder 51 obliquely upward with the medium supporting surface 4 as a guide.

Figure 4:
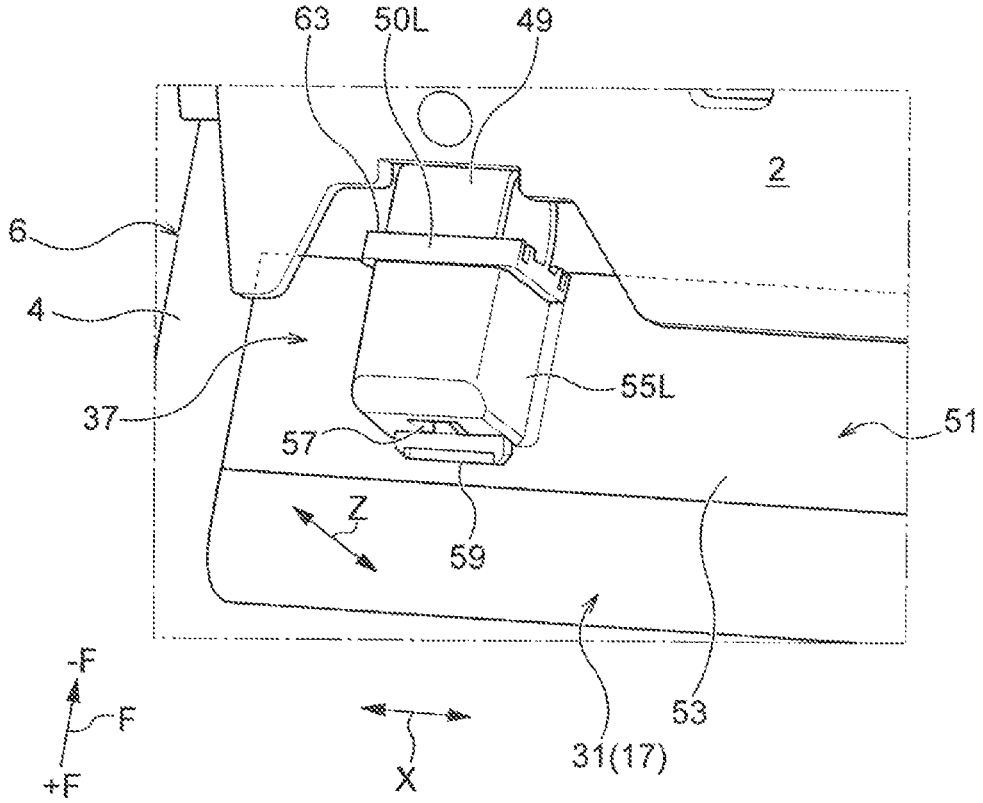
FIG. 4 is an enlarged view of a portion A of FIG. 3 and illustrates an operating state of a main portion of the printing apparatus according to the embodiment of the present disclosure in a state after the preprocessing portion is mounted.
Figure 5:
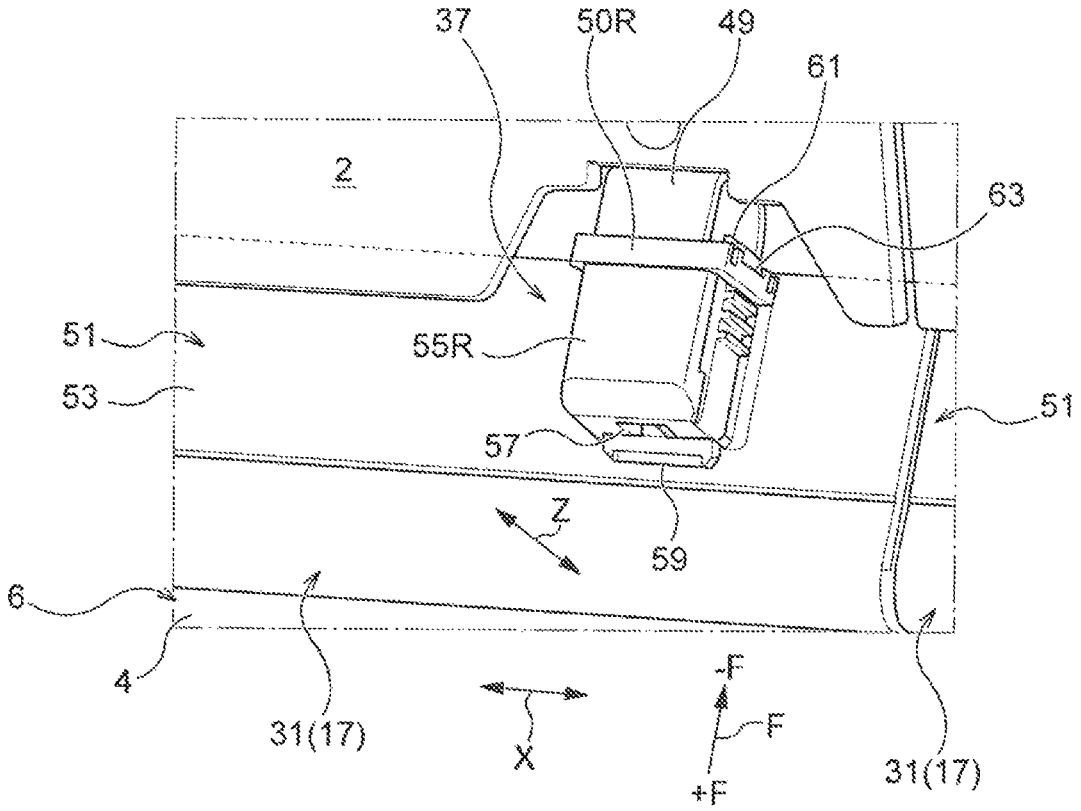
FIG. 5 is an enlarged perspective view of a portion B of FIG. 3 and illustrates an operating state of a main portion of the printing apparatus according to the embodiment of the present disclosure in a state after the preprocessing portion is mounted.

(B) State after Preprocessing Portion is Mounted (See FIGS. 4 and 5)

When the socket parts 55L and 55R are inserted into the mount parts 50L and 50R, the position in the height direction Z and the width direction X is set, and the engaging claws 59 engage with the engagement holes 57 as the socket parts 55L and 55R are pushed to the end of the insertion direction. At the same time, the elastic engaging claws 61 engage with the engagement receptacles 63 such that the position in the insertion direction, i.e., the transport direction F is set, and thus the mounted state illustrated in FIGS. 4 and 5 in which the socket parts 55L and 55R serving as the mount portion are mounted to the mount parts 50L and 50R is established.

Note that when the socket parts 55L and 55R are mounted to the mount parts 50L and 50R, the engaging claws 59 enter, and protrude downward from, the engagement holes 57, which are open at the lower ends of the socket parts 55L and 55R as described above. Further, the elastic engaging claws 61 on the outer side of the socket parts 55L and 55R engage with the engagement receptacles 63 of the mount parts 50L and 50R, and the movement in the insertion direction and the pullout direction is restricted.

(4) Operation and Effect of Printing Apparatus

According to the printing apparatus 1A according to this embodiment having the above-described configuration, with the position-setting mechanism 37 using snap fit, the user can easily attach and detach the dust catcher 31 serving as the preprocessing portion 17 to and from the mount portion 50 of the device main body 2 without using a tool.

In addition, when the fitting portion 55 is fitted to the mount portion 50, the attachment position of the dust catcher 31 is naturally set, and thus the dust catcher 31 can be attached at the same attachment position each time when the dust catcher 31 is removed and attached. As a result, even when the dust catcher 31 is attached and removed to and from the mount portion 50, the position of the dust catcher 31 with respect to the medium supporting surface 4 is easily maintained at a predetermined position, and thus reduction in debris removing performance can be suppressed.

In addition, in this embodiment, the medium supporting surface 4 is configured to be used as a guide for mounting the dust catcher 31 to the mount portion 50, and thus, even when the maintenance of the dust catcher 31 is left to the user, the user can perform the maintenance in a short time without feeling a burden. Further, since an appropriate pressing force can be set to the dust catcher 31 so as to be mounted and disposed with no gaps, the performance of the dust catcher 31 is sufficiently provided.

Figure 6:
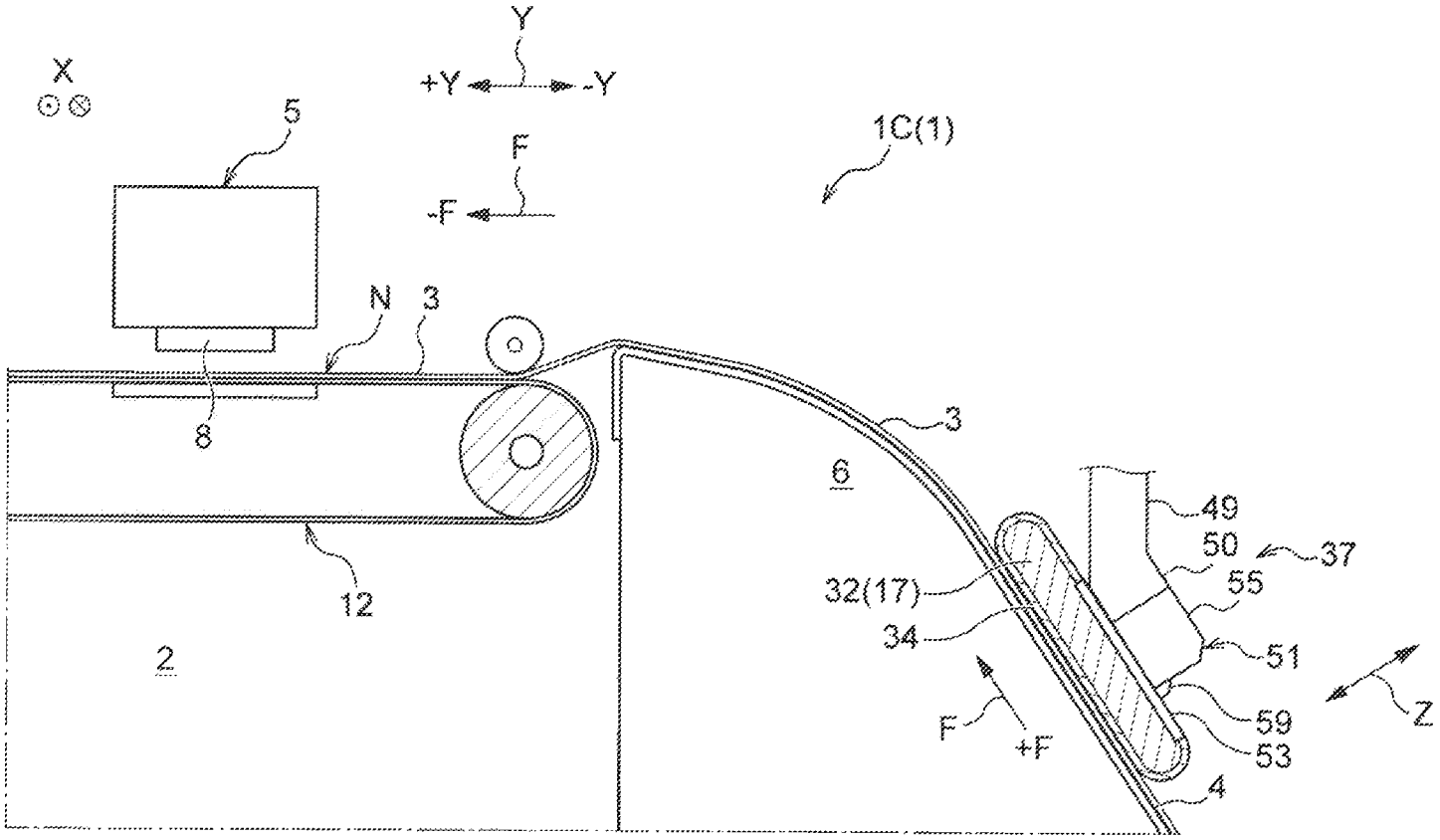
FIG. 6 is an enlarged side sectional view illustrating a main portion of a printing apparatus according to a second embodiment of the present disclosure.

Second Embodiment (See FIG. 6)

With reference to FIG. 6, the following describes a configuration, operation and effect of a printing apparatus 1C according to a second embodiment of the present disclosure, which is partially different in configuration from the first embodiment.

The printing apparatus 1C according to the second embodiment is a so-called textile printing apparatus configured to perform printing on fabric N, in which the preprocessing portion 17 performs a process of putting down fuzz specific to the fabric N.

As such, descriptions of configurations similar to those of the first embodiment are omitted below, and a configuration specific to the textile printing apparatus that performs printing on the fabric N, which is a configuration that is specific to this embodiment and is different from the first embodiment, is mainly described.

The printing apparatus 1C according to the this embodiment includes a printing portion 5 configured to perform printing on a printing surface 3 of fabric N, a transporting portion 12 configured to transport the fabric N in a transport direction F, a medium supporting portion 6 (fabric supporting portion) disposed upstream +F of the printing portion 5 in the transport direction F and including a fabric supporting surface 4 configured to support the fabric N, a fuzz compression portion 32 located upstream +F of the printing portion 5 in the transport direction F and configured to compress fuzz of the printing surface 3, and a mount portion 50 located opposite the fabric supporting surface 4 and configured such that the fuzz compression portion 32 is detachably attached to mount portion 50.

The mount portion 50 includes a position-setting mechanism 37 configured to set the position of the fuzz compression portion 32 with respect to the fabric supporting surface 4 when the fuzz compression portion 32 is mounted.

Specifically, in this embodiment, the fuzz compression portion 32 replaces the dust catcher 31 provided as the preprocessing portion 17 in the first embodiment, and the distance between the fabric supporting surface 4 and the fuzz compression portion 32 is greater, by the thickness of the fabric N, than the distance between the medium supporting surface 4 and the dust catcher 31 of the first embodiment.

In addition, in this embodiment, to transport the fabric N, a belt conveyor suitable for transporting the fabric N is used as the transporting portion 12. The belt conveyor is, for example, an adhesive belt having an adhesive applied to the surface thereof.

As such, in this embodiment, the mount portion 50 is provided to an appropriate support frame or the like disposed in a fixed state in the device main body 2, and the fuzz compression portion 32 is mounted to the fixed mount portion 50.

Also with the printing apparatus 1C according to this embodiment having the above-described configuration, the same function and effect as the printing apparatus 1A according to the first embodiment are provided, and the fuzz compression portion 32 can be repeatedly mounted at an optimal position where the fuzz compression portion 32 can sufficiently provide the function with eased attaching/detaching operation.

Other Embodiments

While the printing apparatus 1 according to the present disclosure basically has the above-described configuration, various modifications and deletions may occur insofar as they are within the gist of the present disclosure.

For example, while, in the first embodiment, the power transmission mechanism 23 capable of switching the preprocessing portion 17 between the contact state and the separation state in association with a nip-release operation of the driven roller 9 by the driven roller holder 15 is employed, and the mount portion 50 is provided on the support arm 49 located at the output end of the operation transmission mechanism 23, the power transmission mechanism 23 may not be provided. In such a case, the mount portion 50 may be provided to an appropriate support frame or the like disposed in a fixed state in the device main body 2 as in the second embodiment such that the preprocessing portion 17 is mounted to the mount portion 50 in the fixed state.

In addition, the position-setting mechanism 37 is not limited to the snap-fit mechanism described in the first embodiment, and the position-setting mechanism 37 may be of a screw-fixing type in which a position setting portion and a fixed portion are separately provided, or the like, for example.

Figure 7:
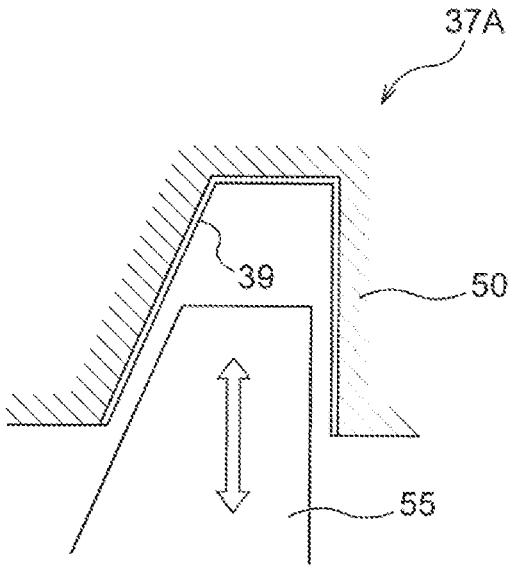
FIG. 7 is a plan view illustrating a position-setting mechanism according to another embodiment of the present disclosure.

In addition, as a position-setting mechanism 37 of another embodiment, a position-setting mechanism 37A having a configuration such as that illustrated in FIG. 7 may also be employed. The position-setting mechanism 37A is a position-setting mechanism of a fitting type with the mount portion 50 and the fitting portion 55 having a wedge shape tapered in the insertion direction. An elastic member 39 such as rubber is bonded on the inner wall surface of the mount portion 50, and when the fitting portion 55 is inserted into the mount portion 50, the position of the fitting portion 55 is set by the elastic force of the elastic member 39 and the friction force at the contact portion between the fitting portion 55 and the mount portion 50.

Figure 8:
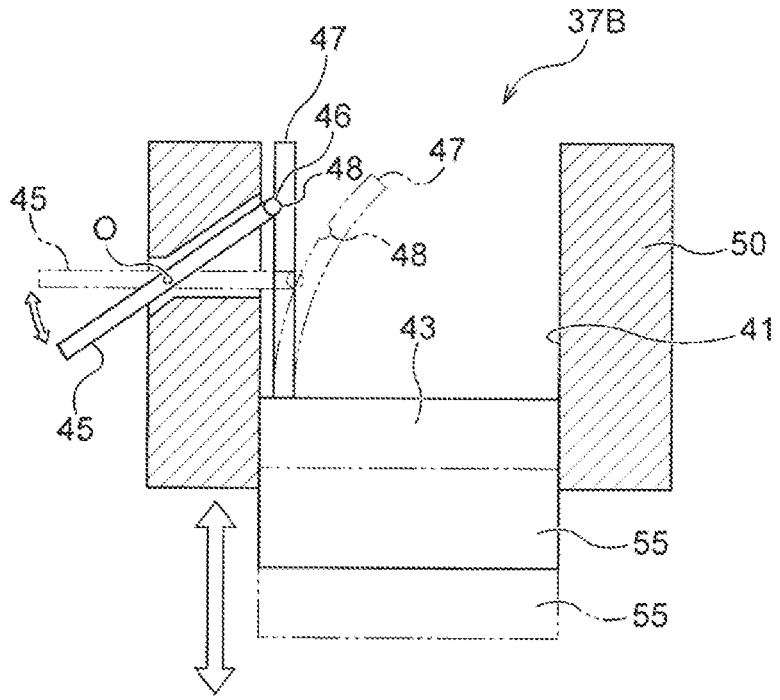
FIG. 8 is a plan view illustrating a position-setting mechanism according to yet another embodiment of the present disclosure.

In addition, a position-setting mechanism 37B having a configuration such as that illustrated in FIG. 8 may also be employed as a position-setting mechanism 37 of another embodiment. The position-setting mechanism 37B includes a fitting hole 41 on the mount portion 50 side and a fitting protrusion 43, on the fitting portion 55 side, that internally fits in the fitting hole 41. In addition, a turning lever 45 that turns about a fulcrum O is attached to the mount portion 50 side, and a tip end 46 of the turning lever 45 reaches the inside of the fitting hole 41 through the side wall of the mount portion 50.

On the other hand, an elastically deformable plate member 47 is provided at the tip of the fitting protrusion 43 of the fitting portion 55, and a recess 48 to which the tip end 46 of the turning lever 45 is fitted is formed on the outer surface of the plate member 47.

When the fitting protrusion 43 of the fitting portion 55 having such a configuration is inserted to the fitting hole 41 of the mount portion 50, the plate member 47 strikes the tip end 46 of the turning lever 45 as indicated by the imaginary line, and enters the fitting hole 41 while bending inward by the elasticity so as to rotate the turning lever 45 counterclockwise.

When the turning lever 45 is turned to the position indicated by the solid line, the turning lever 45 exceeds the balance position, and the position of the fitting portion 55 is set by the elasticity of the plate member 47 and the engagement between the tip end portion 46 of the turning lever 45 and the recess 48 of the plate member 47.

In addition, an appropriate guide member may be provided in at least one of the mount portion 50 and the fitting portion 55. With such a guide member, even when the positions of the mount portion 50 and the fitting portion 55 are initially shifted, the positions of the two parts are guided by the guide member to the optimal positions, and thus the attaching/detaching operation of the preprocessing portion 17 is further eased.

In addition, the entire region of the medium supporting surface 4 may not be used as the guide of the medium M to the transporting portion 11 for mounting the preprocessing portion 17 to the mount portion 50, and only the region necessary for mounting the fitting 55 to the mount portion 50 can be used as a guide.

Figure 2:
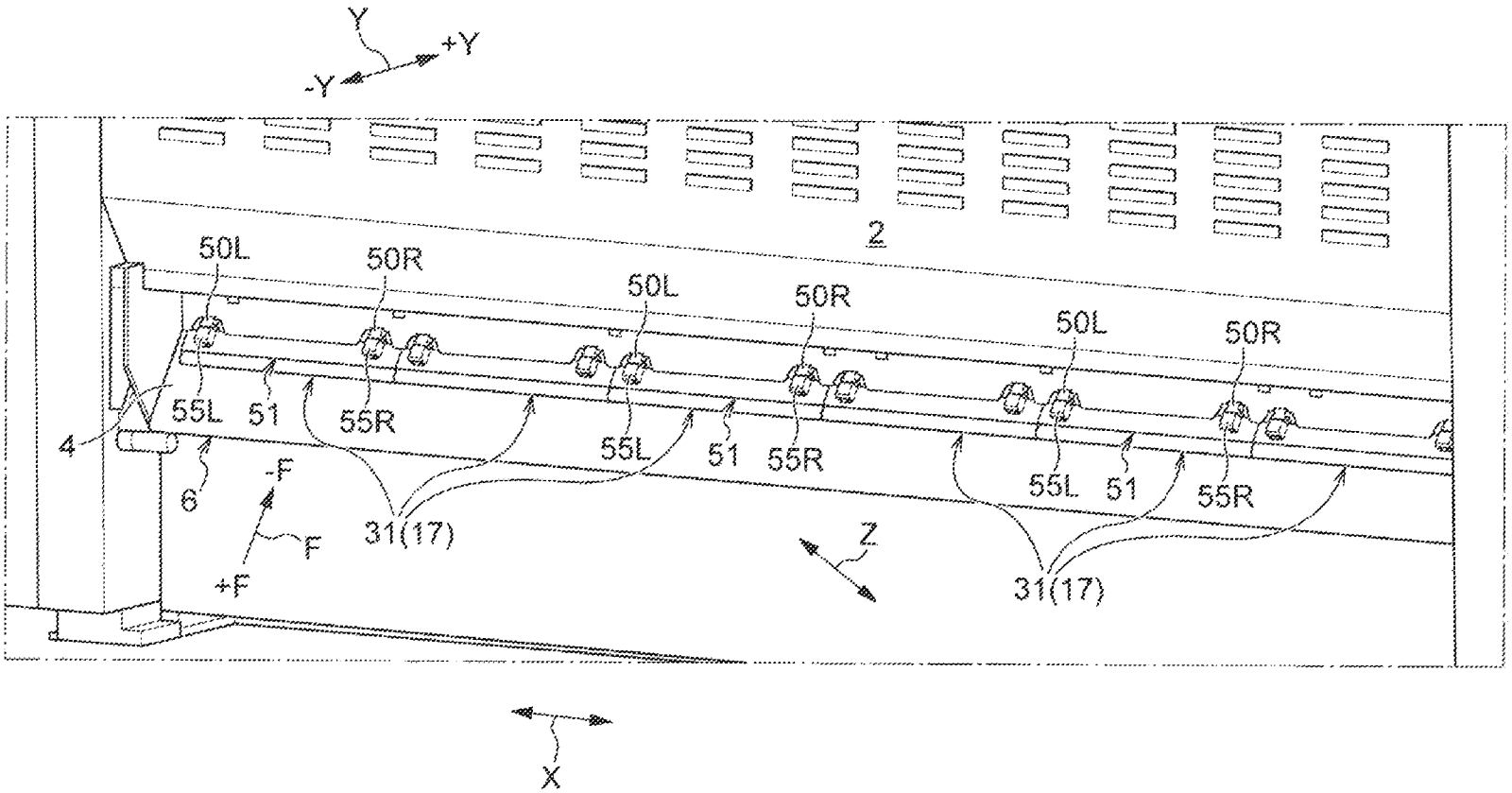
FIG. 2 is an enlarged perspective view illustrating a main portion of the printing apparatus according to the first embodiment of the present disclosure.

In such a case, a configuration may be adopted in which the portion used as the guide on the upstream +F side in the transport direction F is a smooth surface, and the remaining portion to the transporting portion 11 on the downstream −F side in the transport direction F is a curved surface as illustrated in FIG. 1.

What is claimed is:

1. A printing apparatus comprising:

a printing portion configured to perform printing on a printing surface of a medium;

a transporting portion configured to transport the medium in a transport direction;

a medium supporting portion located upstream of the printing portion in the transport direction, the medium supporting portion including a medium supporting surface configured to support the medium;

a preprocessing portion configured to perform preprocessing on the medium supported by the medium supporting portion; and a mount portion facing the medium supporting surface, the mount portion being configured such that the preprocessing portion is detachably mounted thereto, wherein the mount portion includes a position-setting mechanism configured to set a position of the preprocessing portion with respect to the medium supporting surface, and wherein the preprocessing portion is configured to be switchable between a contact state where the processing portion is brought into contact with the printing surface of the medium and a separation state where the preprocessing portion is separated from the printing surface of the medium in association with a movement of the transporting portion.

2. The printing apparatus according to claim 1, wherein the position-setting mechanism is a snap fit.

3. The printing apparatus according to claim 1, wherein the mount portion is disposed with respect to the medium supporting surface such that the medium supporting surface serves as a guide for mounting the preprocessing portion to the mount portion.

4. The printing apparatus according to claim 1, wherein the preprocessing portion includes a flat surface portion that is configured to contact with the medium supporting surface in a state where the preprocessing portion is mounted to the mount portion.

5. The printing apparatus according to claim 1, wherein the medium supporting surface is an inclined surface with a rising slope that intersects an access direction of attaching the preprocessing portion to the mount portion.

6. The printing apparatus according to claim 1, wherein the transporting portion is disposed upstream of the printing portion in the transport direction; and the preprocessing portion and the mount portion are disposed upstream of the transporting portion in the transport direction.

7. The printing apparatus according to claim 1, comprising a second preprocessing portion disposed upstream of the printing portion in the transport direction, wherein the preprocessing portion and the second preprocessing portion are provided side by side along an intersecting direction intersecting the transport direction.

8. The printing apparatus according to claim 1, wherein the preprocessing portion is a dust catcher configured to collect dust adhered to a surface of the medium.

* * * * *